US006323162B1

(12) United States Patent
Yasunori et al.

(10) Patent No.: US 6,323,162 B1
(45) Date of Patent: Nov. 27, 2001

(54) LUBRICANT OIL COMPOSITION FOR INTERNAL COMBUSTION ENGINES (LAW960)

(75) Inventors: Sougawa Yasunori; Katsuya Arai, both of Saitama-ken (JP)

(73) Assignee: TonenGeneral Sekiyu K.K., Saitama (JP)

( * ) Notice: Subject to any disclaimer, the term of this patent is extended or adjusted under 35 U.S.C. 154(b) by 0 days.

(21) Appl. No.: 09/580,686

(22) Filed: May 30, 2000

(30) Foreign Application Priority Data

May 10, 1999 (JP) ..... 11-128143

(51) Int. Cl.[7] ..... C10M 105/04; C10M 169/04

(52) U.S. Cl. ..... 508/192; 508/371; 508/372; 508/373; 508/376

(58) Field of Search ..... 508/192

(56) References Cited

U.S. PATENT DOCUMENTS

| | | | | |
|---|---|---|---|---|
| 4,375,418 | | 3/1983 | Zoleski, eta l. | 252/33.4 |
| 5,064,546 | * | 11/1991 | Dasai | 252/32.5 |
| 5,372,703 | * | 12/1994 | Kamiya et al. | 208/58 |
| 5,391,307 | | 2/1995 | Yamazaki, et al. | 252/32.5 |
| 5,688,748 | * | 11/1997 | Tomizawa | 508/363 |
| 5,880,073 | * | 3/1999 | Tomizawa et al. | 508/383 |
| 6,063,741 | | 5/2000 | Naitoh et al. | 508/365 |

FOREIGN PATENT DOCUMENTS

| | | | |
|---|---|---|---|
| 0855437 | 7/1998 | (EP) | C10M/135/18 |
| 08164777 | 1/1998 | (EP) | C10M/139/00 |
| 1016706 | 7/2000 | (EP) | C10M/163/00 |

OTHER PUBLICATIONS

Japanese Laid Open Patent Application 8–73878 equivalent.
Japanese Laid Open Patent Application 54–103404, (Derwent 69141B/38).
Japanese Laid Open Patent Application 54–113604, (Derwent 75921B/42).
Japanese Laid Open Patent Application 5–230485, (Derwent 93–317776/40).

* cited by examiner

*Primary Examiner*—Ellen M. McAvoy
(74) *Attorney, Agent, or Firm*—Linda M. Scuorzo

(57) ABSTRACT

The present invention provides for a lubricant oil composition for internal combustion engines, that resists oxidation in the presence of NOx and evaporation characteristics, and controls poisoning of a three-way catalyst system for occluding/reducing NOx and formation of deposit in an air intake system. The lubricant oil composition for internal combustion engines, comprises a base oil, which contains aromatic compounds at 1 wt. % or less, sulfur at 10 ppm or less, and paraffin and monocyclic naphthene compounds at 50 wt. % or more as total content, and has a kinematic viscosity of 2 to 50 $mm^2/s$ at 100° C. and evaporated quantity of 16 wt. % or less determined by the NOACK evaporation test, wherein the base oil is incorporated with a zinc dithiophosphate at 0.04 to 0.10 wt. % as phosphorus, a calcium phenate and/or calcium sulfonate having a total basic number of 100 to 400 mg KOH/g at 1 to 10 wt. %, and a polyalkenyl succinimide having a boron/nitrogen wt. ratio of 0 to 1.2 and alkenyl group of 1,000 to 3,500 in molecular weight at 0.01 to 0.20 wt. % as nitrogen.

5 Claims, No Drawings

LUBRICANT OIL COMPOSITION FOR INTERNAL COMBUSTION ENGINES (LAW960)

FIELD OF THE INVENTION

This invention relates to a lubricant oil composition, more particularly the composition resistant to an air atmosphere containing nitrogen oxide (NOx) gases at high temperature, excellent in resistance to oxidation in the presence of NOx and evaporation characteristics, and suitable for internal combustion engines which control formation of deposit in an air intake system, in particular gasoline engines equipped with a catalytic system to occlude/reduce NOx or exhaust gas recirculation system (EGR), and lean-burn gasoline engines.

BACKGROUND OF THE INVENTION

Lubricant oils are used for internal combustion engines, automatic and manual transmissions, differential gears, power steerings, shock absorbers, and gears, for their smooth operation. In internal combustion engines, in particular, lubricant oils have been used mainly for piston rings, cylinder liners, bearings for crank shafts and connecting rods, valve trains including cams and valve lifters, and other sliding members. In addition to the lubricating purposes above described, they are also used for cooling engines, cleaning and dispersing combustion products, and prevention of rust and corrosion.

As described above, lubricant oils for internal combustion engines are required to exhibit a variety of functions. These requirements are becoming even severer, as the engines become more functional, produce higher power and are operated under severer conditions. In order to satisfy these requirements, base oils for lubricant oils for internal combustion engines are incorporated with a variety of additives, such as ashless dispersants, metallic detergents, antiwear agents, friction reducing agents and antioxidants.

Combustion gases produced by an internal combustion engine partly leak into the crank case as blow-by gases through a space between the piston and cylinder. NOx gases contained in the combustion gases at a fairly high proportion can deteriorate a lubricant oil in the internal combustion engine, in a concerted manner with oxygen present in the blow-by gases. Lean-burn engines are now being widely used, to improve fuel economy. These engines are equipped with a three-way catalyst system to prevent/reduce NOx or exhaust gas recirculation (EGR) system to abate NOx emissions. A three-element catalyst is known to be poisoned by sulfur, and it is necessary, when the catalytic system is used, to control the sulfur poisoning resulting from evaporation of the engine oil. It is also necessary, when an EGR system is used, to control deposit at the intake valve and contamination of the EGR control valve with the engine oil components, resulting from inflow of the engine oil into the EGR system.

An engine oil for internal combustion engines, in particular lean-burn engines, is required to be low in volatility and difficult to be deposited even when it is evaporated to flow into the EGR system. In other words, it is required to be high in oxidation stability. Deposits can be also formed by sludge in the oil, resulting from oxidation and deterioration of the oil by NOx present in the blow-by gases, and the oil is required to control formation of such sludge.

A variety of additives have been proposed to improve oxidation stability and serviceability of engine oils for internal combustion engines. These engine oils include solid impurity agglomerating type diesel engine oils incorporated with a calcium phenate, magnesium sulfonate and alkenyl succinimide (Japanese Patent Publication No.3-29839), diesel engine oils incorporated with a combination of an ashless dispersant, metallic detergent and the like (Japanese Patent Publication No.6-60317), engine oils incorporated with an antioxidant of sulfur-containing phenol derivative or the like (Japanese Laid-open Patent Application No.6-93281, equivalent to U.S. Pat. No. 5,569,405), engine oils incorporated with a specific antioxidant or the like (Japanese Laid-open Patent Application No.7-126681, Derwent Abs. 95-213285/28), and diesel engine oils incorporated with a combination of 3 types of additives (Japanese Laid-open Patent Application No.7-207290, Derwent Abs. 95-309399/40).

A variety types of base oils have been also proposed to improve properties of engine oils. These base oils include the one based on mineral oil prepared to have a viscosity index of at least 80, and contain basic nitrogen at 5 ppm or less and aromatic compounds at 1% or less for the lubricant oil composition serviceable in a NOx-containing atmosphere (JP 2,564,556, Derwent Abs. 89-050214/07), the one based on mineral oil or the like prepared to have a viscosity of 2 to 50 cSt at 100° C. and contain aromatic compounds at 2% or less for internal combustion engine oils serviceable in a NOx-containing gas atmosphere (Japanese Patent Publication No. 6-62988), and the one based on mineral oil containing total aromatic compounds at 2 to 15 wt. %, and isoparaffin and monocyclic naphthene compounds at 60 wt. % or more as total content in the saturates (JP 2,724,508, equivalent to U.S. Pat No. 5,372,703).

It is accepted that use of a base oil consuming less oil or engine oil incorporated with a lower content of viscosity index improver is an effective means to control or prevents deposit on intake valves or the like for lubricant oils for internal combustion engines.

In spite of these proposals, however, no lubricant oil composition can sufficiently control poisoning of a three-way catalyst system for preventing/reducing NOx and deposit in an air intake system in lean-burn engines.

In an embodiment, the present invention provides a lubricant oil composition for internal combustion engines, excellent in resistance to oxidation in the presence of NOx and evaporation characteristics, and controlling poisoning of a 3-element catalytic system for preventing/reducing NOx and formation of deposit in an air intake system.

SUMMARY OF THE INVENTION

The inventors have found that a lubricant oil composition for internal combustion engines shows enhanced resistance to oxidation in the presence of NOx and evaporation characteristics, and controls poisoning of a three-way catalyst system for preventing/reducing NOx and formation of deposit in an air intake system, when it comprises a mineral oil, having a specific content of aromatic compounds and sulfur and total content of paraffin and monocyclic naphthene compounds, and also having a specific evaporated quantity determined by the NOACK evaporation test, as the base oil, which is incorporated with 3 types of specific additives at a specific content.

One embodiment of the present invention provides a lubricant oil composition for internal combustion engines comprising a base oil, which contains aromatic compounds at 1 wt. % or less, sulfur at 10 ppm or less, and paraffin and monocyclic naphthene compounds at greater than 50 wt. % as total content, and has a kinematic viscosity of 2 to 50

$mm^2/s$ at 100° C. and evaporated quantity of 16 wt. % or less determined by the NOACK evaporation test, wherein the base oil is incorporated with (A) a zinc dithiophosphate at 0.04 to 0.10 wt. % as phosphorus, (B) a calcium phenate and/or calcium sulfonate having a total basic number of 100 to 400 mg KOH/g at 1 to 10 wt. %, and (C) a polyalkenyl succinimide having a boron/nitrogen wt. ratio of 0 to 1.2 and alkenyl group of 1,000 to 3,500 in molecular weight at 0.01 to 0.20 wt. % as nitrogen.

Another embodiment of the present invention provides for a method of operating lean-burn gasoline engines.

An embodiment of this invention relates, as described above, to a lubricant oil composition comprising a base oil, which contains a specific content of aromatic compounds and sulfur, specific total content of paraffin and monocyclic naphthene compounds, and has a specific kinematic viscosity at 100° C. and specific NOACK evaporation quantity, the improvement of which comprises the 3 types of specific additives at the specific content as described above.

Other preferred embodiments of the present invention include:

A method for lubricating an internal combustion engine equipped with a three-way catalyst system (particularly lean burn gasoline engine) to prevent/reduce NOx or EGR system by adding to such engine a lubricating oil composition comprising a base oil of lubricating viscosity and the specific additives described above;

A lubricant oil composition of one of the above wherein a secondary zinc alkyl dithiophosphate is the sole compound for the zinc dithiophosphate;

A lubricant oil composition of one of the above, wherein the calcium phenate has a total basic number of 200 to 350 mg KOH/g;

A lubricant oil composition of one of the above, wherein the polyalkenyl succinimide has a boron/nitrogen wt. ratio of 0.1 to 0.8 and alkenyl group of 1,000 to 3,500 in molecular weight.

The present invention may comprise, consist or consist essentially of the element or steps recited herein, and include the compositions and methods of making them.

DETAILED DESCRIPTION OF THE PREFERRED EMBODIMENTS

With respect to the present invention:

Lubricant Base Oil

It is important that the base oil for the lubricant oil composition of the present invention to contain aromatic compounds at 1 wt. % or less, sulfur at 10 ppm or less, and paraffin and monocyclic naphthene compounds at 50 wt. % or more as total content, and has a kinematic viscosity of 2 to 50 $mm^2/s$ at 100° C. and evaporated quantity of 16 wt. % or less determined by the NOACK evaporation test.

The base oil for the lubricant oil composition as the major ingredient of the present invention contains aromatic compounds at 1 wt. % or less, preferably 0.5 wt. % or less, more preferably 0.2 wt. % or less, wherein the aromatic content is determined in accordance with ASTM D2549, after these compounds are developed with toluene. At an aromatic content above 1%, resistance of the lubricant oil composition to oxidation in the presence of NOx will be insufficient, making it difficult to achieve the object of the present invention, because of excessive deterioration in an atmosphere containing NOx.

It is important that sulfur is present in the above base oil at 10 ppm or less. At above 10 ppm, the on-board 3-way exhaust gas cleaning-up catalyst to prevent/reduce NOx may be poisoned with sulfur, as the engine oil is consumed. This results from oxidation of sulfur present in the fuel and lubricant oil into $SO_2$ and further to sulfate, which react with the NOx-occluding component of the catalyst to deactivate its function. This phenomenon is known as sulfur poisoning, which is one of the causes for deteriorated NOx-reducing and hence cleaning-up function of the catalyst.

The above base oil also contains paraffin and monocyclic naphthene compounds at 50 wt. % or more as total content, wherein these compounds are determined in accordance with ASTM D2786. At a total content of these compounds below 50 wt. %, the lubricant oil composition will be evaporated excessively, and show insufficient evaporation characteristics. As a result, the engine oil will be consumed more, which is one of the causes for increased quantity of carbon deposit in the air-intake system, e.g., intake valve.

The above base oil has a kinematic viscosity of 2 to 50 $mm^2/s$ at 100° C., preferably 3 to 15 $mm^2/s$. A kinematic viscosity below 2 $mm^2/s$ at 100° C. may cause problems, such as excessive loss of the lubricant oil by evaporation, and increased wear of the sliding members, e.g., piston rings and valve trains. A kinematic viscosity above 50 $mm^2/s$, on the other hand, is also undesirable, because of insufficient viscosity at low temperature to increase wear loss by agitation resistance.

The above base oil also should have an evaporated quantity of 16 wt. % or less determined by the NOACK evaporation test, wherein the evaporated quantity represents the evaporation loss, determined in accordance with CEC L-40-T-87 under the conditions of 250° C., 1 hour and −20 mm $H_2O$ ("NOACK evaporation test"). A NOACK evaporation loss above 16 wt. % may cause problems, such as increased consumption and viscosity of the engine oil, and sulfur-poisoning of the 3-way catalyst to occlude/reduce NOx, resulting from excessive evaporation of the engine oil.

The base oil as the major ingredient of the lubricant composition of the present invention is not limited, so long as the above composition and properties are satisfied. Any one commonly used as a base oil can be used for the present invention.

The base oils useful for the present invention include lubricant oil stocks (e.g., those obtained by atmospheric or vacuum distillation of paraffinic, intermediate or naphthenic crude) treated by an adequate process. They include raffinate obtained by solvent extraction of a stock with an aromatic extractant (e.g., phenol, furfural and N-methyl pyrrolidone); hydrotreated oil obtained by treating a stock with hydrogen under hydrotreatment conditions in the presence of a hydrotreatment catalyst (e.g., cobalt and molybdenum carried by silica-alumina); hydrocrakate obtained by treating a stock with hydrogen under severer hydrocracking conditions; isomerate obtained by isomerizing a stock with hydrogen under isomerization conditions in the presence of an isomerization catalyst; and those fractions obtained by a combination of solvent refining, hydrotreatment, hydrocracking or isomerization. Particularly preferable base oils for the present invention are those having a high viscosity index, obtained by hydrocracking or isomerization. Any process described above can be optionally combined with dewaxing, hydrofinishing, clay treatment or the like operated in a normal manner. More specifically, the base stocks useful for the present invention include light, medium and heavy neutral oils, and bright stocks. These base oils can be mixed with each other, to satisfy the requirements for the present invention.

The lubricant oil composition of the present invention comprises the base oil, as the major ingredient, which have the above described composition and properties. The base oil may be incorporated with a small quantity of another type of base oil, as required, so long as the object of the present invention is not damaged. Such a base to be incorporated into the one for the present invention is not limited, and any mineral or synthetic stock which is normally used as a base oil can be used. When another type of base oil is incorporated, it is preferable that the total base oil satisfies the above described composition and properties.

Additionally, the base oil for the lubricant oil composition of the present invention contains a minor amount of the following additives:

Zinc Dithiophosphate

The base oil for the lubricant oil composition of the present invention is combined with a zinc dithiophosphate as the antiwear agent and antioxidant (essential component (A)). The zinc dithiophosphate is represented, e.g., by the general formula [1]:

[1]

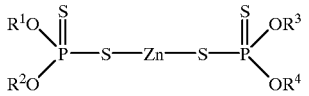

wherein , $R^1$, $R^2$, $R^3$ and $R^4$ are each hydrogen or a hydrocarbon group having a carbon number of 1 to 26, e.g., a primary or secondary alkyl having a carbon number of 1 to 26; alkenyl having a carbon number of 2 to 26; cycloalkyl having a carbon number of 3 to 26; aryl, alkyl aryl or arylalkyl having a carbon number of 3 to 26; or a hydrocarbon group containing an ester or ether bond, or hydroxyl or carboxyl group. Each of them is preferably an alkyl group having a carbon number of 2 to 12, cycloalkyl group having a carbon number of 8 to 18, or alkyl aryl group having a carbon number of 8 to 18. They may be the same or different from each other. Each of them is more preferably a secondary alkyl group.

It is preferable that a zinc dithiophosphate is incorporated at 0.04 to 0.10 wt % as phosphorus derived from the zinc dithiophosphate, based on the whole composition. At below 0.04 wt. %, its antiwear effect may be insufficient under the conditions of high temperature and low rotational velocity. When it exceeds 0.10 wt. %, on the other hand, its antiwear effect may not increase as expected for its content, and may conversely cause problems, such as sulfur poisoning of the 3-elemetn catalyst to occlude/reduce NOx for cleaning-up automobile exhaust gases, because of increased sulfur content derived from the zinc dithiophosphate as the engine oil is consumed.

Metallic Detergent

The base oil for the lubricant oil composition of the present invention is also combined with a calcium phenate and/or calcium sulfonate as the metallic detergent (essential component (B)). The calcium phenate is represented, e.g., by the general formula [2] or [3]:

[2]

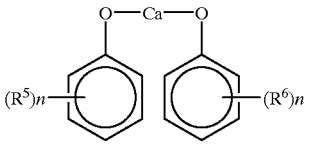

[3]

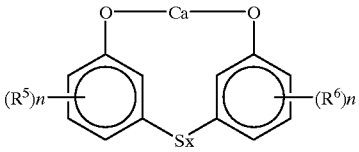

wherein, $R^5$ and $R^6$ are each an alkyl group, which may be the same or different; (n) is number of alkyl substituent(s) on the aromatic ring, and an integer of 1 to 5, preferably 1 to 2; and (x) in the general formula [3] is an integer of 1 to 5. The alkyl group has a carbon number of 8 to 28, preferably 10 to 22. When the carbon number is below 8, the metallic detergent may not be sufficiently dissolved in the lubricant oil. When it exceeds 28, on the other hand, the acid-neutralizing function of the detergent may not increase as expected for its content, and may conversely cause problems, such as oxidation of the alkyl group in the metallic detergent, deteriorating the detergent itself into a deposit.

The calcium phenate as the essential component (B) for the lubricant oil composition of the present invention is a calcium salt of alkyl phenol or sulfurized alkyl phenol, and overbasified. Total basic number (herein is determined using the hyperchloride method, JIS K2501) is 100 to 400 mg KOH/g, preferably 200 to 350 mg KOH/g. At a basic number below 100 mg KOH/g, the detergent may have an insufficient function of neutralizing acidic substance formed by oxidation. When it exceeds 400 mg KOH/g, on the other hand, its acid-neutralizing function may not increase as expected for its content, and may conversely accelerate deposition of calcium carbonate in the metallic detergent.

The calcium sulfonate as the essential component (B) for the lubricant oil composition of the present invention is represented, e.g., by the general formula [4] to [6]:

[4]

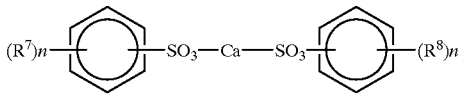

[5]

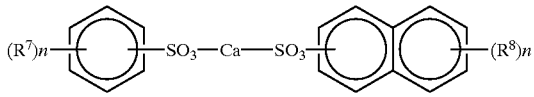

[6]

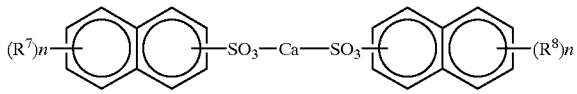

wherein, $R^7$ and $R^8$ are each a hydrocarbon group, which may be the same or different; and (n) is number of alkyl substituent(s) on the aromatic or naphthalene ring, and an integer of 1 to 5 or 1 to 7, respectively, preferably 1 to 2. The hydrocarbon group is an alkyl or alkenyl group having a carbon number of 8 to 28, preferably an alkyl group having a carbon number of 10 to 22. When the carbon number is below 8, the metallic detergent may not be sufficiently dissolved in the lubricant oil. When it exceeds 28, on the other hand, the acid-neutralizing function of the detergent may not increase as expected for its content, and may conversely cause problems, such as oxidation of the alkyl group in the metallic detergent, deteriorating the detergent itself into a deposit.

The calcium sulfonate as the essential component (B) for the lubricant oil composition of the present invention is a calcium salt of sulfonic acid having a hydrocarbon group (e.g., petroleum-derived sulfonic acid, and sulfonic acid having a long-chain alkyl benzene and alkyl naphthalene), and overbasified. Its total basic number is 100 to 400 mg KOH/g, preferably 200 to 400 mg KOH/g. At a basic number (by above hyperchloride method) below 100 mg KOH/g, the detergent may have an insufficient function of neutralizing acidic substance formed by oxidation. When it exceeds 400 mg KOH/g, on the other hand, its acid-neutralizing function may not increase as expected for its content, and may conversely accelerate deposition of calcium carbonate in the metallic detergent.

The calcium phenate and/or calcium sulfonate as the essential component (B) for the lubricant oil composition of the present invention is contained at 1 to 10 wt. % as the total content based on the whole composition. At a total content below 1 wt. %, the detergent may have an insufficient acid-neutralizing function. When it exceeds 10 wt. %, on the other hand, its acid-neutralizing function may not increase as expected for its content, and may conversely cause problems, such as oxidation of the metallic detergent, deteriorating itself into a deposit. When the calcium phenate and calcium sulfonate are used simultaneously, the ratio is not limited and can be freely changed, so long as their total content is 1 to 10 wt. %.

Polyalkenyl Succinimide

The lubricant oil composition of the present invention is also contains a polyalkenyl succinimide (essential component (C)). The polyalkenyl succinimide is a mono-type polyalkenyl succinimide represented by the general formula [7],

[7]

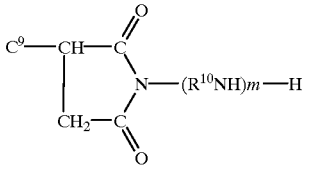

bis-type polyalkenyl succinimide represented by the general formula [8],

[8]

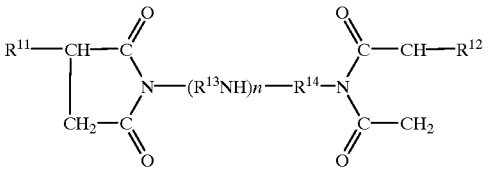

or these compounds treated with a boron compound, wherein, $R^9$, $R^{11}$ and $R^{12}$ are each an oligomer residue of α-olefin having a carbon number of around 2 to 8 or the hydrotreated oligomer residue, and $R_{11}$ *and* $R^{12}$ may be the same or different; $R^{10}$, $R_{13}$ and $R^{14}$ are each an alkylene group having a carbon number of 2 to 4, and $R^{13}$ and $R^{14}$ may be the same or different; and (m) and (n) are each an integer of 1 to 10 and 0 to 10, respectively.

The component (C) for the present invention is a mono-type represented by the general formula [7], which may be treated by a boron compound; a bis-type represented by the general formula [8], which may be treated by a boron compound; or a mixture thereof. It is important, when the polyalkenyl succinimide is treated with a boron compound, that the boron/nitrogen weight ratio of the compound is in a range from 0 to 1.2, preferably from 0.1 to 0.8 for improved resistance of the compound to heat. When the ratio exceeds 1.2, the function of the compound for dispersing oxidized substance may be insufficient, to increase quantity of deposit in the air-intake system, making it difficult to attain the object of the present invention.

The polyalkenyl succinimide represented by the general formula [7] or [8] is generally produced by reacting a polyalkenyl succinic anhydride, as a reaction product of polyolefin and maleic anhydride, with a polyalkylene polyamine. The mono- or bis-polyalkenyl succinimide can be produced by changing reaction ratio of the polyalkenyl succinic anhydride to polyalkylene polyamine.

The polyolefin useful for production of polyalkenyl or polyalkyl succinimide is generally selected optionally from the polymers of an α-olefin compound having a carbon number of around 2 to 8. An α-olefin compound for the polyolefin may be used individually or in combination of one or more of other α-olefin compounds. The preferable polyolefin is a polybutene.

The polyalkylene polyamine useful for the present invention includes polyethylene polyamine, polypropylene polyamine and polybutylene polyamine, of which polyethylene polyamine is more preferable.

The polyalkenyl succinimide for the present invention may be treated with a boron compound by the common method. The boron-treated compound normally has a boron content of 0.1 to 5 wt. %, preferably 0.1 to 2 wt. %.

The alkenyl group in the polyalkenyl succinimide as the component (C) for the lubricant oil composition of the present invention should have a weight-average molecular weight of 1,000 to 3,500, preferably 1,500 to 3,000. When the molecular weight is below 1,000, the function of the polyalkenyl succinimide for dispersing oxidized substance may be insufficient, to increase quantity of deposit. When it exceeds 3,500, on the other hand, the compound itself may be oxidized to increase quantity of deposit, although it may retain a sufficient function for dispersing oxidized substance. The weight-average molecular weight is that as polybutene, determined by gel permeation chromatography (GPC).

It is necessary for the lubricant oil composition of the present invention to be incorporated with the polyalkenyl succinimide as the component (C) at 0.01 to 0.20 wt. %, based on the whole composition, as nitrogen derived from the polyalkenyl succinimide, preferably 0.01 to 0.15 wt. %. At a content below 0.01 wt. %, the lubricant oil composition may not attain its object. At above 0.20 wt. %, it may also not attain its object, and polyalkenyl succinimide itself may be oxidized into a deposit, increasing quantity of deposit.

Other Additive Components

The lubricant oil composition comprises the base oil in a major amount and having the above described composition and properties, which is incorporated with in a minor amount of the above described (A) a zinc dithiophosphate, (B) a calcium phenate and/or calcium sulfonate, and (C) a polyalkenyl succinimide, each at a specific content. The base oil may be optionally incorporated further with one or more types of additives which are normally used for lubricant oils for internal combustion engines, so long as the object of the present invention is not damaged. These additives include an ashless dispersant, metallic detergent, antiwear agent, friction reducing agent, antioxidant, viscosity index improver, pour point depressant, metal deactivator, rust inhibitor, corrosion inhibitor and antifoaming agent.

The ashless dispersants useful for the present invention include those based on polyalkenyl succinamide, benzyl amine, succinate ester, and succinate ester-amide, and those containing boron, in addition to the above described polyalkenyl succinimide. It is incorporated normally at 0.1 to 10 wt. %.

The metallic detergents useful for the present invention include those based on sulfonates, phenates, salicylates and phosphonates of Ca, Mg and Ba, in addition to the above described calcium sulfonate and phenate. It is incorporated normally at 0.05 to 5 wt. %.

The antiwear agents useful for the present invention include metallic (e.g., Mo, Pb and Sb) salts of dithiophosphate, metallic (e.g., Mo, Pb and Sb) salts of dithiocarbamate, metallic (e.g., Pb) salts of naphthenate, metallic (e.g., Pb) salts of fatty acids, a boron compound, phosphate ester, phosphite ester and phosphate amine, in addition to the above described zinc dithiophosphate. Of these, those based on phosphate ester and metallic salts of dithiophosphate are preferably used. It is incorporated normally at 0.05 to 5 wt. %.

The friction reducing agents useful for the present invention include an organomolybdenum compound, fatty acid, higher alcohol, fatty acid ester, oil and fat, (partial) ester of polyhydric alcohol, sorbitan ester, amine, amide, sulfurized ester, phosphate ester, phosphite ester and amine salt of phosphate ester. It is incorporated normally at 0.05 to 3 wt. %.

The antioxidants useful for the present invention generally include amine-based ones, e.g., alkylated diphenyl amine, phenyl-α-naphthyl amine and alkylated phenyl-α-naphthyl amine; and phenol-based ones, e.g., 2,6-ditertiary butyl phenol and 4,4'-methylene bis-(2,6-ditertiary butyl phenol); sulfur-based ones, e.g., dilauryl-3,3'-thiodipropionate; phosphorus-based ones, e.g., phosphite; in addition to the above described zinc dithiophosphate. Of these, the amine-based and phenol-based ones are preferably used. It is incorporated normally at 0.05 to 5 wt. %.

The viscosity index improvers useful for the present invention generally include polymethacrylate-based one, olefin copolymer-based one (e.g., polyisobutylene-based and ethylene-propylene copolymer-based one), polyalkyl styrene-based one, hydrogenated styrene-butadiene copolymer-based one, and styrene-maleic anhydride ester copolymer-based one. Of these, polymethacrylate-based and olefin copolymer-based ones are preferably used. It is incorporated normally at 1 to 15 wt. %.

The pour point depressants useful for the present invention generally include ethylene-vinyl acetate copolymer, condensate of chlorinated paraffin and naphthalene, condensate of chlorinated paraffin and phenol, polymethacrylate, and polyalkyl styrene. Of these, polymethacrylate is preferably used. It is incorporated normally at 0.01 to 5 wt. %.

The metal deactivators useful for the present invention include benzotriazole, and triazole, benzotriazole and thiadiazole derivatives. It is incorporated normally at 0.001 to 3 wt. %.

The rust inhibitors useful for the present invention include fatty acid, alkenyl succinate half ester, fatty acid soap, alkyl sulfonate, ester of fatty acid and polyhydric alcohol, fatty acid amine, oxidized paraffin and alkyl polyoxyethylene ether. It is incorporated normally at 0.01 to 3 wt. %.

The lubricant oil composition of the present invention may be further incorporated, as required, with other types of additives, e.g., corrosion inhibitor, antifoaming agent and coloring agent.

EXAMPLES

The present invention is described below in detail by EXAMPLES and COMPARATIVE EXAMPLES, which do not limit the present invention.

The panel coking controlling capacity, resistance to oxidation in the presence of NOx in the presence of NOx and evaporation characteristics, cited in EXAMPLES and COMPARATIVE EXAMPLES were analyzed by the following methods:

(1) Method for Assessing Panel Coking Controlling Capacity

The panel coking test was conducted in a NOx-containing air atmosphere, to simulate an air-intake system, in particular intake valve, exposed to NOx-containing blow-by gases or recirculated exhaust gases at high temperature. In the test, the sample oil was added dropwise onto an aluminum panel (kept at 295° C.) at a constant rate of 1.0 g/h for 3 hours from a microsyringe in an air atmosphere containing 1 vol. % of nitrogen dioxide ($NO_2$). The sample oil is carbonized on the panel slanted at 8°, to form the deposit thereon. On completion of the test, the residual oil in the deposit was extracted with petroleum ether, and quantity of the deposit was determined from the difference in the panel weight before and after the test. The development target of the deposit controlling capacity was set at below 80 mg, which is judged to be a good capacity.

(2) Method For Assessing Resistance to Oxidation in The Presence of NOx

The oxidation test was conducted in a NOx-containing air atmosphere, to simulate an engine exposed at high temperature to blow-by gases containing NOx gases, where air containing 1 vol. % of nitrogen dioxide ($NO_2$) was blown into 150 mL of the sample oil at a rate of 2 L/h (i.e., the $N0_2$ and air components blown at 0.02 and 1.98 L/h, respectively) at 155° C. for 48 h. The resistance to oxidation in the presence of NOx was assessed by ratio of kinematic viscosity of the tested sample to that of the untested one. The test sample is judged to have high resistance to oxidation, when the kinematic viscosity ratio is below 1.2. The pentane-insolubles (wt. %) in the tested oil, determined in accordance with ASTM D893 (method B), were also measured, to assess quantity of sludge formed as a result of deterioration of the tested oil by NOx. The sludge in the oil causes deposit in an air intake system, and the tested oil is judged to have good capacity for controlling deposit formation, when it contains the pentane-insolubles at below 1 wt. %.

(3) Method For Assessing Evaporation Characteristics

The evaporation characteristics of the test sample was assessed by the NOACK evaporation test to determine evaporated quantity. As described earlier, the evaporated quantity represents the evaporation loss, determined in accordance with CEC L-40-T-87 under the conditions of 250° C., 1 h and −20 mm $H_2O$. The development target was set at an evaporated quantity of 15 wt. % or less by the NOACK evaporation test, which is judged to be very good evaporation characteristics of a lubricant oil.

Example 1

The base oil 1, whose composition and properties are given in Table 1, was used as the base oil which was incorporated with (A) a secondary alkyl ($C_6$) zinc dithiophosphate at 0.10 wt. % as phosphorus, (B) a calcium phenate having a total basic number (TBN) of 250 mg KOH/g and alkyl group (R) having a carbon number of 12 at 2.0 wt. %, (C) a polyalkenyl succinimide having a boron/nitrogen wt. ratio of 0.2 and polyalkenyl group of 2600 in molecular weight at 0.10 wt. % as nitrogen, and other commonly used additives (e.g., viscosity index improver and antifoaming agent) at a total content of 4.0 wt. %, to prepare the lubricant oil composition. It was subjected to the tests for assessing panel coking controlling capacity, resistance to oxidation in the presence of NOx and evaporation characteristics. The results are given in Table 2. The lubricant oil composition exhibits good panel coking controlling capacity, resistance to oxidation in the presence of NOx and evaporation characteristics.

Example 2 to 7

The base oil 1, whose composition and properties are given in Table 1, was used as the base oil, as was the case with EXAMPLE 1, which was incorporated with the additives given in Table 2 or 3 at contents (based on the whole composition) also given in the table, to prepare the lubricant oil compositions. They were subjected to the tests for assessing panel coking controlling capacity, resistance to oxidation in the presence of NOx and evaporation characteristics, as was the case with EXAMPLE 1. The results are given in Table 2 or 3. The lubricant oil compositions exhibit good panel coking controlling capacity, resistance to oxidation in the presence of NOx and evaporation characteristics.

Comparative Examples 1 to 5

The base oil 1 or 2, whose composition and properties are given in Table 1, was used, as was the case with each of EXAMPLE 1 to 7, as the base oil which was incorporated with the additives given in Table 3 at contents (based on the whole composition) also given in the table, to prepare the lubricant oil compositions. They were subjected to the tests for assessing panel coking controlling capacity, resistance to oxidation in the presence of NOx and evaporation characteristics. The results are given in Table 3.

TABLE 1

| | Base Oil 1 | Base Oil 2 |
|---|---|---|
| Kinematic viscosity @ 100° C., $mm^2/s$ | 4.7 | 4.8 |
| Aromatic content, wt. % | 0.1 | 7.3 |
| Total content of paraffin and monocyclic Naphthene compounds, wt. % | 57 | 42 |
| Sulfur content, wt. % | 0.00 | 0.31 |
| Evaporated quantity determined by NOACK test, wt. % | 16 | 19 |

TABLE 2

| | Example 1 | Example 2 | Example 3 | Example 4 | Example 5 | Example 6 |
|---|---|---|---|---|---|---|
| Base oil 1, wt % | Balance | Balance | Balance | Balance | Balance | Balance |
| Base oil 2, wt % | — | — | — | — | — | — |
| Sec. C6-ZnDTP*[1], wt. % as P in oil | 0.10 | — | 0.10 | 0.10 | 0.10 | 0.10 |
| Pri. C8-ZnDTP*[2], wt. % as P in oil | — | 0.10 | — | — | — | — |
| Ca phenate*[3], TBN250, R = 12, wt. % | 2.0 | 2.0 | 0.10 | — | — | — |
| Ca phenate, TBN143, R = 12, wt. % | — | — | — | 3.5 | — | — |
| Ca sulfonate, TBN300, $ = 15–18, wt. % | — | — | — | — | 1.7 | — |
| Succinimide*[4], MW2600, B/N = 0.2, wt. % as N | 0.10 | 0.10 | 0.10 | 0.10 | 0.10 | — |
| Succinimide, MW1500, B/N = 0, wt. % as N | — | — | — | — | — | 0.10 |
| Succinimide, MW1700, B/N = 1.1, wt. % as N | — | — | — | — | — | — |
| Succinimide, MW2000, B/N = 1.3, wt. % as N | — | — | — | — | — | — |
| Other additives*[5], wt. % | 4.0 | 4.0 | 4.0 | 4.0 | 4.0 | 4.0 |

TABLE 2-continued

| | Example 1 | Example 2 | Example 3 | Example 4 | Example 5 | Example 6 |
|---|---|---|---|---|---|---|
| Quantity of panel coking deposit*6, mg | 36 | 43 | 48 | 49 | 42 | 56 |
| Assessment of evaporated quantity determined by NOACK test, wt. % | 15 | 15 | 15 | 15 | 15 | 15 |
| Resistance to oxidation in the presence of Nox (155° C. 48 h) | | | | | | |
| • Ratio of kinematic viscosity @ 100° C. before and after the oxidation test at 100° C. | | | | | | |
| • Insolubles in the tested oil (quantity of sludge)*7, wt. % | | | | | | |

*1: Secondary alkyl (C6) zinc dithiophosphate was added at a concentration shown above as phosphorus.
*2: Primary alkyl (C8) zinc dithiophosphate was added at a concentration shown above as phosphorus.
*3: Calcium phenate having a total basic number (TBN) of 250 mg KOH/g and alkyl group (R) having a carbon number of 12.
*4: Polyalkenyl succinimide having a boron/nitrogen wt. Ratio of 0.2 and polyalkenyl group of 2600 in molecular weight (MW) at a given content as phosphorus.
*5: Other additives, i.e., viscosity index improver and antifoaming agent, were added at a given total content of 4.0 wt. %.
*6: Panel coking test conditions; panel temperature: 295° C., oil dropping rate: 1.0 g/h, test atmosphere: air containing 1 vol. % of $NO_2$, and test time: 3 hours.
*7: Pentane-insolubles, determined in accordance with ASTM D893 (method B).

TABLE 3

| | EXAMPLE 7 | COMPARATIVE EXAMPLE 1 | COMPARATIVE EXAMPLE 2 | COMPARATIVE EXAMPLE 3 | COMPARATIVE EXAMPLE 4 | COMPARATIVE EXAMPLE 5 |
|---|---|---|---|---|---|---|
| Base oil 1, wt. % | Balance | — | Balance | Balance | Balance | Balance |
| Base oil 2, wt. % | — | Balance | — | — | — | — |
| Sec. C6-ZnDTP*1, wt. % as P in oil | 0.10 | 0.10 | — | 0.10 | 0.10 | 0.10 |
| Pri. C8-ZnDTP*2, wt. % as P in oil | — | — | — | — | — | — |
| Ca Phenate*3, TBN250, R = 12, wt. % | 2.0 | 2.0 | 2.0 | — | 2.0 | — |
| Ca sulfonate, TBN30, R = 15–22, wt. % | — | — | — | — | — | 2.0 |
| Ca phenate, TBN143, R = 12, wt. % | — | — | — | — | 1.7 | — |
| Ca sulfonate, TBN300, R = 15–18, wt. % | — | — | — | — | — | — |
| Succinimide*4, MW2600, B/N = 0.2, wt. % as N | — | 0.10 | 0.10 | 0.10 | — | 0.10 |
| Succinimide, MW1500, B/N = 0, wt. % as N | — | — | — | — | — | — |
| Succinimide, MW1700, B/N = 1.1, wt. % as N | 0.10 | — | — | — | — | — |
| Succinimide, MW2000, B/N = 1.3, wt. % as N | — | — | — | — | 0.10 | — |
| Other additives*5, wt. % | 4.0 | 4.0 | 4.0 | 4.0 | 4.0 | 4.0 |
| Quantity of panel coking deposit*6, mg | 73 | 168 | 156 | 143 | 136 | 132 |
| Assessment of evaporated quantity determined by NOACK test, wt. % | 15 | 18 | 15 | 15 | 15 | 15 |
| Resistance to oxidation in the presence of Nox (155° C. 48 h) | | | | | | |
| • Ratio of kinematic viscosity @ 100° C. before and after the oxidation test at 100° C. | 1.07 | 1.31 | 1.56 | 1.32 | 1.26 | 1.29 |
| • Insolubles in the tested oil (quantity of sludge)*7, wt. % | 0.64 | 1.68 | 2.48 | 1.93 | 1.36 | 1.84 |

*1: Secondary alkyl (C6) zinc dithiophosphate was added at a concentration shown above as phosphorus.
*2: Primary alkyl (C8) zinc dithiophosphate was added at a concentration shown above as phosphorus.
*3: Calcium phenate having a total basic number (TBN) of 250 mg KOH/g and alkyl group (R) having a carbon number of 12.
*4: Polyalkenyl succinimide having a boron/nitrogen wt. Ratio of 0.2 and polyalkenyl group of 2600 in molecular weight (MW) at a given content as phosphorus.
*5: Other additives, i.e., viscosity index improver and antifoaming agent, were added at a given total content of 4.0 wt. %.
*6: Panel coking test conditions; panel temperature: 295° C., oil dropping rate: 1.0 g/h, test atmosphere: air containing 1 vol. % of $NO_2$, and test time: 3 hours.
*7: Pentane-insolubles, determined in accordance with ASTM D893 (method B).

As described above, the lubricant oil composition prepared by each EXAMPLE demonstrates enhanced performance by incorporating the base oil of given composition and properties (aromatic, sulfur and paraffin/monocyclic naphthene contents, and kinematic viscosity at 100° C. and NOACK evaporation quantity in specific ranges) with 3 specific additives. More concretely, each satisfies the development targets for panel coking controlling capacity (small quantity of deposit formed), resistance to oxidation in the presence of NOx (small viscosity increase and small quantity pentene-insolubles, or sludge formed) and NOACK evaporation quantity. For example, the results of EXAMPLE 1 indicate that quantity of deposit formed in the panel coking test is small at 36 mg, viscosity little increases before and after the test for assessing resistance to oxidation in the presence of NOx (viscosity ratio: 1.02) and quantity of insolubles (pentane-insolubles, determined in accordance with ASTM D893, method B) is small at 0.21 wt. %, and NOACK evaporation quantity is 15 wt. %, which satisfies the development target. Similarly, those prepared by EXAMPLES 2 to 7 demonstrate enhanced performance.

On the other hand, the lubricant oil composition prepared by COMPARATIVE EXAMPLE 1 comprised the base oil, which, although having a kinematic viscosity at 100° C.

within the range for the present invention, was out of the ranges with respect to aromatic, sulfur and paraffin/monocyclic naphthene contents and NOACK evaporation quantity, incorporated with the same additives at the same contents as those for EXAMPLE 1. It showed a larger quantity (168 mg) of deposit formed by the panel coking test, increased in viscosity by the oxidation test to have a higher viscosity ratio, and contained a larger quantity of the insolubles in the oxidation-tested composition. Its NOACK evaporation quantity was also larger. Similarly, those prepared by COMPARATIVE EXAMPLES 2 to 5 failed to satisfy the development targets for the panel coking controlling capacity and resistance to oxidation in the presence of NOx.

It is apparent, based on these results, that a lubricant oil composition is difficult to exhibit high qualities in terms of panel coking controlling capacity, resistance to oxidation in the presence of NOx and evaporation characteristics, unless its base oil has an aromatic, sulfur and paraffin/monocyclic naphthene content, and kinematic viscosity at 100° C. and NOACK evaporation quantity in specific ranges. In other words, it is apparent that a lubricant oil composition exhibits good panel coking controlling capacity, resistance to oxidation in the presence of NOx and evaporation characteristics, and controls formation of deposit in an air-intake system, when its base oil has an aromatic, sulfur and paraffin/monocyclic naphthene content, and kinematic viscosity at 100° C. and NOACK evaporation quantity in specific ranges, and is incorporated at least with 3 specific additives each at specific content.

The lubricant oil composition of the present invention exhibits enhanced performance in terms of resistance to oxidation in the presence of NOx, evaporation characteristics and capacity of controlling formation of deposit in an air-intake system by incorporating the base oil, which contains a specific content of aromatic compounds and sulfur, specific total content of paraffin and monocyclic naphthene compounds, and has a specific kinematic viscosity at 100° C. and specific NOACK evaporation quantity, with 3 specific additives.

The lubricant oil composition of the present invention is suited for internal combustion engines, in particular gasoline engines equipped with a catalytic system to prevent/reduce NOx or exhaust gas recirculation system, and lean-burn gasoline engines.

What is claimed is:

1. A lubricant oil composition, comprising a major amount of a base oil and a minor amount of aromatic compounds at 1 wt. % or less, sulfur at 10 ppm or less, and paraffin and monocyclic naphthene compounds at 50 wt. % or more as total content, and has a kinematic viscosity of 2 to 50 $mm^2/s$ at 100° C. and evaporated quantity of 16 wt. % or less determined by the NOACK evaporation test, and a minor amount of a zinc dithiophosphate at 0.04 to 0.10 wt. % as phosphorus, a calcium phenate and/or calcium sulfonate having a total basic number of 100 to 400 mg KOH/g at 1 to 10 wt. %, and a polyalkenyl succinimide having a alkenyl group of 1,000 to 3,500 in molecular weight at 0.01 to 0.20 wt. % as nitrogen.

2. The composition of claim 1 wherein the calcium phenate has a total base number of 200 to 350 mg KOH/g.

3. The composition of claim 1 wherein the zinc dithiophosphate is a secondary zinc alkyl dithiophosphate.

4. The composition of claim 1 wherein the polyalkenyl succinimide is a boronated polyalkenyl succinimide having a boron/nitrogen ratio of 0 to 1.2.

5. A method of lubricating an internal combustion engine by providing to such engine a lubricating oil composition comprising a base oil containing aromatic compounds at 1 wt. % or less, sulfur at 10 ppm or less, and paraffin and monocyclic naphthene compounds at 50 wt. % or more as total content, and has a kinematic viscosity of 2 to 50 $mm^2/s$ at 100° C. and evaporated quality of 16 wt. % or less determined by the NOACK evaporation test, and a minor amount of a zinc dithiophosphate at 0.04 to 0.10 wt. % as phosphorus, a calcium phenate and/or calcium sulfonate having a total basic number of 100 to 400 mg KOH/g at 1 to 10 wt. %, and a polyalkenyl succinimide having a alkenyl group of 1,000 to 3,500 in molecular weight at 0.01 to 0.20 wt. % as nitrogen.

* * * * *